US008103512B2

(12) United States Patent
Kim

(10) Patent No.: US 8,103,512 B2
(45) Date of Patent: Jan. 24, 2012

(54) METHOD AND SYSTEM FOR ALIGNING WINDOWS TO EXTRACT PEAK FEATURE FROM A VOICE SIGNAL

(75) Inventor: Hyun-Soo Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 1106 days.

(21) Appl. No.: 11/656,873

(22) Filed: Jan. 23, 2007

(65) Prior Publication Data

US 2007/0192102 A1 Aug. 16, 2007

(30) Foreign Application Priority Data

Jan. 24, 2006 (KR) ..... 10-2006-0007504

(51) Int. Cl.
*G10L 19/00* (2006.01)

(52) U.S. Cl. ..... 704/500; 704/200; 704/200.1; 704/201; 704/501

(58) Field of Classification Search ..... 704/500, 704/501, 200–201
See application file for complete search history.

(56) References Cited

U.S. PATENT DOCUMENTS

| | | | | |
|---|---|---|---|---|
| 5,781,885 | A * | 7/1998 | Inoue et al. | 704/267 |
| 6,031,822 | A | 2/2000 | Wallmeier | |
| 6,167,093 | A * | 12/2000 | Tsutsui et al. | 375/242 |
| 6,226,608 | B1 * | 5/2001 | Fielder et al. | 704/229 |
| 6,360,198 | B1 * | 3/2002 | Imai et al. | 704/207 |
| 6,636,830 | B1 * | 10/2003 | Princen et al. | 704/204 |
| 2003/0115052 | A1 * | 6/2003 | Chen et al. | 704/230 |
| 2007/0016405 | A1 * | 1/2007 | Mehrotra et al. | 704/203 |
| 2007/0078650 | A1 * | 4/2007 | Rogers | 704/229 |

FOREIGN PATENT DOCUMENTS

| | | |
|---|---|---|
| JP | 10-093591 | 4/1998 |
| JP | 11-184497 | 9/1999 |
| KR | 1999-024267 | 3/1999 |
| KR | 10-0246756 | 12/1999 |
| KR | 10-0246756 | 3/2000 |
| KR | 1020050073761 | 7/2005 |

OTHER PUBLICATIONS

Childers et al., Gender Recognition from Speech: Part II: Fine Analysis, J. Scoust. Soc. Am. 90 (4), Pt. 1, Oct. 1991.

* cited by examiner

*Primary Examiner* — Douglas Godbold
(74) *Attorney, Agent, or Firm* — The Farrell Law Firm, P.C.

(57) ABSTRACT

Disclosed is a method capable of adaptively aligning windows to extract features according to the types and characteristics of voice signals. To this end, window lengths based on the window update points in a corresponding order are determined by employing the concept of a higher order peak, and windows are aligned according to window lengths. When the windows are aligned according to such a manner, the start and end points of each window is known, so that it becomes possible to easily extract and analyze peak feature information.

11 Claims, 4 Drawing Sheets

• P1 (1 ST ORDER PEAK)
⊙ P2 (2 ND ORDER PEAK)

METHOD AND SYSTEM FOR ALIGNING WINDOWS TO EXTRACT PEAK FEATURE FROM A VOICE SIGNAL

PRIORITY

This application claims the benefit under 35 U.S.C. 119(a) of an application entitled "Method And System For Aligning Window To Extract Peak Feature From Voice Signal" filed in the Korean Intellectual Property Office on Jan. 24, 2006 and assigned Serial No. 2006-7504, the entire contents of which are incorporated herein by reference.

BACKGROUND OF THE INVENTION

1. Field of the Invention

The present invention relates generally to a method and system for aligning windows for voice signals, and in particular, to a method and system for aligning windows to extract a peak feature from voice signals in such a manner that the windows can be easily updated while minimizing variations even if the voice signals are discontinuous and transient.

2. Description of the Related Art

Recently, various systems for aligning windows using voice signals have been developed. The systems perform the application processes using voice signals, such as coding, synthesis, recognition, and reinforcement. To this end, the systems using voice signals extract peak feature information from voice signals according to the application fields of the systems. Therefore, in order to efficiently apply the extracted peak feature information to different application processes, it is necessary to extract exact peak feature information.

Generally, such a voice signal processing system employs a signal processing method, which processes voice signals in a block unit, based on windows having a fixed length, which has been established for extracting and calculating a peak feature, and an update rate. That is, the voice signal processing system uses fixed-length data windows. However, in order to achieve reliable calculations of peak features that are different depending on application fields, it is preferred to process voice signals in a block unit suitable for each application field. Peak calculation requires only three data points, while linear predictive coding (LPC) or cepstral coefficient calculation requires a window length determined by considering a complicated relation between variability and repeatability. When peak feature information is extracted from a voice signal, it is not always necessary that window lengths have a fixed value.

Nevertheless, generally, a fixed-length data window and fixed update rate have been used for extraction of peak information because of the following reasons:

First, the fixed-length data window and fixed update rate can be easily used in the voice signal processing system because equal values of same are applied at all times. However, until an optimum value is determined, the voice signal processing system must be tested with various window lengths and update rates. Moreover, one parameter to output an optimum result must have been obtained through such a test, before the parameter is always used as a fixed value. Meanwhile, it can be assumed that window length and update rate must be fixed for optimum processing, but such an assumption is unsuitable because it is impossible to control background noise in a general application processing. That is, in an environment that includes noise, it is difficult to obtain an optimum processing result with a fixed window length and fixed update rate Secondly, although it is desirable to use a variable window length and update rate, there is no standard approach to and no theoretical basis for how to determine a window length and update rate every time. That is, there is no simple approach to using a variable window length and update rage.

Thirdly, both a fixed window length and update rate have been used in order to reduce processing requirements. Although the conventional voice signal processing systems have aimed at reducing the amount of calculation as much as possible, however presently, given the tremendous improvement in processing capabilities of processors, the amount of calculation does not matter because.

A window update rate is a different parameter from a window length. If a window length is too long, too much information is included in the corresponding window, so that it becomes difficult to extract peak feature information. Therefore, a window update rate is determined inside of a boundary of a window length or in a limited range of the window length, in which peak feature information can be extracted. For instance, the maximum update interval in voice processing is of an order of 40 ms, which corresponds to about half of the minimum voice energy pulse. In this case, if an update interval is at least 40 ms, the update interval may overstep an energy pulse. In contrast, the minimum update interval is 0 ms. In most cases, a fixed update interval has one value ranging from 8 to 16 ms.

As described above, the conventional voice signal processing system have used fixed values in order to determine a window length or the start and end points of a data window. Therefore, it is necessary to provide a window alignment method that is supported by a theoretical basis or logic according to the types or characteristics of voice signals to be processed There is a need for a method for aligning windows, which can adaptively update the windows even if peak feature information has the same characteristics as those of a Discrete Fourier Transform (DFT) coefficient and data have discrete points.

SUMMARY OF THE INVENTION

Accordingly, the present invention provides a method and system for aligning windows to extract a peak feature information from voice signals in such a manner that the windows can be easily updated while minimizing variance even if the voice signals are discontinuous and transient.

Therefore, according to the present invention, there is provided a system for aligning a window to extract a peak feature of a voice signal, the system having a peak information extraction unit for extracting peak feature information from a received voice signal; an update point determination unit for determining a window update point by using the peak information; a window length determination unit for determining a window length by shifting a window based on the update point; a window alignment unit for aligning a window according to the determined window length; and a window analysis unit for performing window analysis for feature extraction by detecting start and end points of the window from the aligned window.

Further, according to the present invention, there is provided a method for aligning a window to extract a peak feature of a voice signal, the method having extracting peak feature information from a received voice signal; determining a window update point by using the peak information; determining a window length by shifting a window based on the update point; aligning a window according to the determined window length; and performing window analysis for feature extraction by detecting start and end points of the window from the aligned window.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, one preferred embodiment of the present invention will be described with reference to the accompanying drawings. In the following description of the embodiment of the present invention, a detailed description of known functions and configurations incorporated herein will be omitted when it can obscure the subject matter of the present invention.

The present invention provides a method for adaptively aligning windows to extract features according to the types and characteristics of voice signals. To this end, the present invention provides a method for aligning windows according to window length units, by determining window lengths based on the window update points of a corresponding order on the concept of a higher order peak. It is possible to find the start and end points of each window, when windows are aligned according to such a manner, so that it becomes possible to easily extract and analyze peak feature information.

Figure 1:
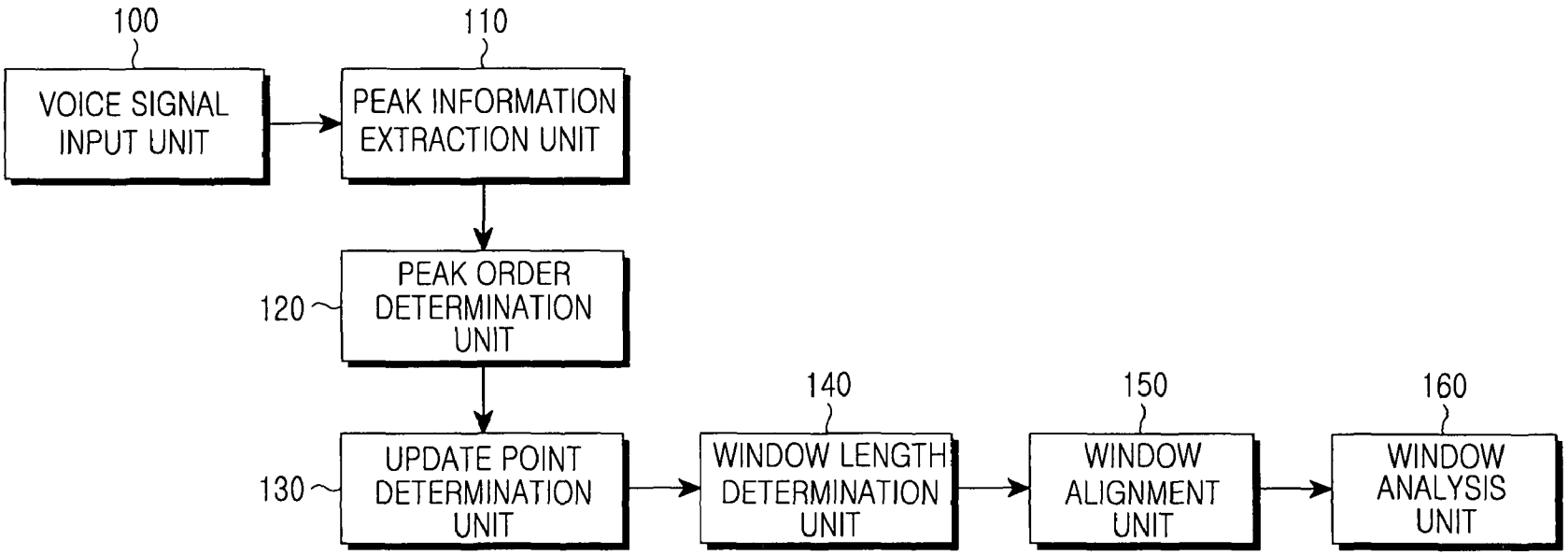
FIG. 1 is a block diagram schematically illustrating the construction of a system for performing window alignment according to the present invention.

The construction and operation of a system, which performs the above-mentioned window alignment function, will now be described with reference to FIG. 1. FIG. 1 is a block diagram schematically illustrating the construction of a system for performing window alignment.

A window alignment system according to the present invention includes a voice signal input unit 100, a peak information extraction unit 110, a peak order determination unit 120, an update point determination unit 130, a window length determination unit 140, a window alignment unit 150, and a window analysis unit 160.

The voice signal input unit 100 can include a microphone (MIC) for receiving sound signals including voice signals.

The peak information extraction unit 110 extracts peak information from the received signal from the voice signal input unit 100, the peak information extraction unit 110 first extracts first-order peak information from the received signal, and then extracts peak information of each order by using a higher-order peak theorem for extracting meaningful data.

The peak order determination unit 120 defines an order of each peak extracted by the peak information extraction unit 110, and determines peaks of an order to be used by comparing a peak feature value of a current order with a threshold value optimized according to the system, i.e., with a preset threshold peak feature value. In this case, the amount of variance reduction for each value is used as a basis of the comparison step. Once it is determined that an $N^{th}$-order peak is to be used, it is unnecessary to extract peaks of an order higher than the $N^{th}$ order.

In detail, the peak order determination unit 120 defines a peak order for the extracted peak information, when peak information is extracted from a voice signal on a time domain by the peak information extraction unit 110. Then, the peak order determination unit 120 compares a peak feature value in the defined current peak order with a preset threshold peak feature value, and determines the current peak order to be a peak order to be used if the peak feature value in the defined current peak order is greater than or equal to the preset threshold peak feature value.

In contrast, if the peak feature value in the defined current peak order is less than the preset threshold peak feature value, the peak order determination unit 120 defines a new peak order by increasing the value of the current peak order, and determines the new peak order to be a peak order to be used if the peak feature value in the newly-defined peak order is greater than or equal to the preset threshold peak feature value, which is repeatedly performed until a peak order to be used is determined.

Figure 3A:
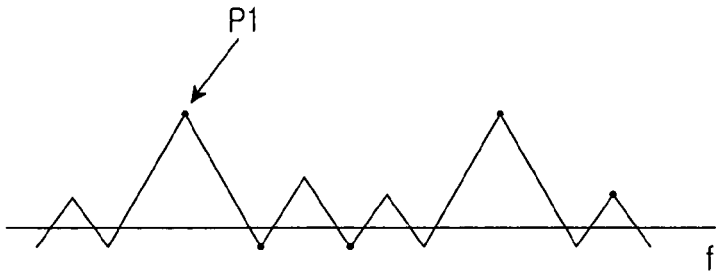
FIGS. 3A to 3C are views explaining a procedure for defining an $N^{th}$-order peak according to the present invention.
Figure 3B:
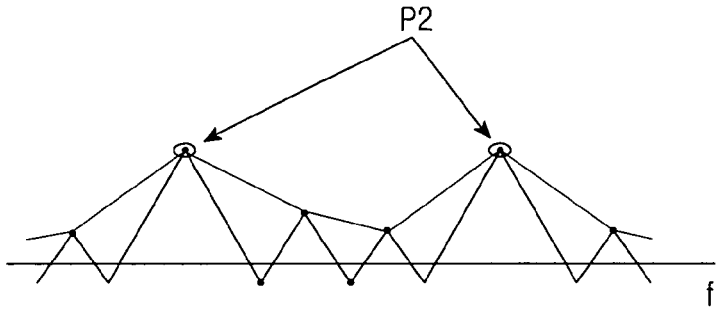
Figure 3C:
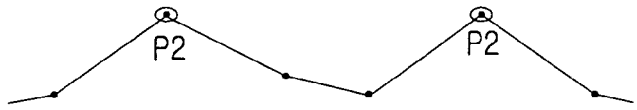

Before a detailed description for the remaining components, the concept of a higher-order peak used in the present invention will be described briefly. According to the present invention, when a typical peak is called a "first-order peak", a peak in signals including a plurality of first-order peaks is defined as a second-order peak, as shown in FIGS. 3A to 3C. Similarly, the third-order peaks represent peaks among signals including the second-order peaks. By such an process, the higher-order peak is defined.

Therefore, the second-order peaks can be found by regarding the first-order peaks as a new time series and extracting peaks from the new time series. In the same manner, it is also possible to define higher-order minima, i.e., valleys. Therefore, the second-order valleys represent local minima in a time series including the first-order valleys.

Such higher-order peaks and valleys can be used as efficient statistics upon extracting features from voice or audio signals, and particularly, the second-order and third-order peaks include pitch information of a voice or audio signal. In addition, a time interval or the number of sampling points between the second-order or third-order peaks include lots of information about extraction of features of a voice or audio signal. Therefore, it is preferred that the peak order determination unit 120 selects second-order or third-order peaks among peaks extracted by the peak information extraction unit 110.

In addition, a lot of information can be obtained by analyzing peak characteristics of multiple orders based on a time and frequency axis. Particularly, basic statistics (such as histogram analysis, average, and standard deviation) and secondary statistics obtained by a ratio of the values of the basic statistics can be used to extract efficient characteristics. The periodicity characteristics and voicing characteristics, which are obtained, using these statistics, are very useful information, and it is necessary to recognize a correct peak order in order to extract these characteristics.

According to the characteristics of the higher-order peak proposed by the present invention, lower-order peaks averagely have lower levels, and higher-order peaks appear relatively less frequently. For instance, the second-order peaks have higher levels than the first-order peaks, and are of a smaller number than that of the first-order peaks.

The peak rate in each order can be efficiently used to extract features from a voice or audio signal, and particularly, the second-order and third-order peaks include pitch extraction information.

Meanwhile, the rules of the higher-order peaks are as follows.

1. Successive peaks (or valleys) have only one valley (or peak) there between.

2. Rule No. 1 is applied to peaks (valleys) of every order.

3. A number of higher-order peaks (valleys) are smaller than that of lower-order peaks (valleys), and higher-order peaks (valleys) are provided as a preset of lower-order peaks (valleys).

4. Two successive higher-order peaks (or valleys) always have at least one lower-order peak there between.

5. Higher-order peaks (valleys) averagely have smaller levels than those of relatively lower-order peaks (valleys).

6. There is an order in which only one peak and one valley (e.g. maximum and minimum in one frame) exist within a signal during a specific period (e.g. during one frame).

The peak order determination unit 120 can define peaks extracted by the peak information extraction unit 110 as the first-order peaks based on the rules of the higher-order peaks. Then, the peak order determination unit 120 checks the standard deviation and average of the first-order peaks. When it is determined that the first-order peaks have a higher periodicity than a reference value, the peak order determination unit 120 selects the current order as an order to be used, but when it is determined that the first-order peaks have a lower periodicity than the reference value, the peak order determination unit 120 increases the current order. That is, the peak order determination unit 120 determines an order to be used by checking the standard deviation and average of each-order peaks. Herein, the reference value is a threshold value to optimize a corresponding system.

If only the first-order peaks are used in a general system at all times, selecting a peak order may be set as an additional option because it is possible to omit the step of determining a peak order, but according tithe present invention, the peak order determination unit 120 uses the second-order peaks as default.

According to the present invention, there is provided a method for aligning windows by using the concept of the higher-order peak. To this end, the method according to the present invention detects an order capable of minimizing a standard deviation through a variance reduction check while increasing an order from the second-order peak, which is a default value, and uses the detected order when aligning windows. In this case, since actual systems can obtain a satisfactory standard deviation using only a window alignment method based on the second-order peaks, the actual systems can obtain good performance without using a higher order than the second order. The window alignment method according to the present invention determines a window length according to the type of voice signal to be processed, thereby enabling efficiently utilizing the characteristics of the voice signal.

When the peak order determination unit 120 has determined an order, the update point determination unit 130 determines peaks of the determined order to be window update points. Therefore, the update point determination unit 130 updates a window update point whenever a peak appears in the determined order.

The procedure for determining a window update point will now be described in detail. First, as shown in FIGS. 3A to 3C, new peaks detected from a signal including the first-order peaks are defined as the second-order peaks.

FIGS. 3A to 3C are views explaining a procedure for defining an $N^{th}$-order peak according tithe present invention. FIG. 3A shows the first-order peaks. The peak order determination unit 120 defines peaks extracted by the peak information extraction unit 110 as the first-order peaks $P_1$, as shown in FIG. 3A. Next, as shown in FIG. 3B, peak points appearing when the first-order peaks $P_1$ are sequentially connected are detected. Then, the detected peak points are defined as the second-order peaks $P_2$, as shown in FIG. 3C.

FIGS. 3A to 3C shows peaks of each order which are required for extracting meaningful data from a voice signal in a time domain. Referring to FIG. 3A, a portion at which a signal feature is suddenly changed appears as a peak, as indicated by reference mark "$P_1$". Such a portion, at which a signal feature is changed, corresponds to a portion between a voiced sound and a voiceless sound, or the start and end portions of a voice signal, e.g., a portion between words.

In FIGS. 3A to 3C, the lateral axis represents position values and the longitudinal axis represents height values. Therefore, it is possible to determine an order to be used, by using the variance and average of height values for peaks of each order, which are illustrated in FIGS. 3A to 3C showing the concept of the higher-order peak. Generally, a variance is calculated from position values, and an average is calculated from height values. A voiced sound has a lower variance than a voiceless sound, and has a greater average than the voiceless sound. Conversely, a voiceless sound has a higher variance than a voiced sound, and has a lower average than the voiced sound. Generally, a non-periodic sound has a high variance.

Since the start and end portions of a voice signal have characteristics as described above, the peak order determination unit 120 can determine an order to be used, by determining if peak information of a current order has a high periodicity or a low periodicity based on peak information extracted by the peak information extraction unit 110. That is, if peaks of a current order have a lower periodicity than a reference value, the peak order determination unit 120 defines a higher order than the current order.

When the second-order peaks are used as default, the first second-order peak $P_2$ in FIG. 3B is determined to be a window update point. Then, the update point determination unit 130 determines the second second-order peak $P_2$ in FIG. 3B to be the second window update point. In such a manner, the update point determination unit 130 determines update points one by one whenever a second-order peak appears.

When the update point determination unit 130 has determined the first update point, the window length determination unit 140 shifts a window from a current update point to the next second-order peak.

Accordingly, the window length determination unit 140 determines a length between the first and second update points to be a window length.

When a window length determination unit 140 has determined a window length, as described above, the window alignment unit 150 aligns a window according to the unit of the determined window length.

When a window has been aligned, the window analysis unit 160 can know the start and end points of the window, so that the window analysis unit 160 can analyze the window and can extract peak feature information according to the window length unit. The extracted peak feature information is transmitted through a preprocessing procedure to the next-stage signal processing system, so that the peak feature information can be used upon voice coding, recognition, synthesis, and reinforcement in all voice signal processing systems.

The window alignment system as described above determines peaks of a corresponding order on a one-by-one basis is to be an update point, and then determines a length between two adjacent update points to be a window length. Then, the window alignment system aligns a window according to the window length unit determined in such a manner, so that it becomes possible to extract peak information from the corresponding window. This method determines a window length according to the type and characteristics of a signal to be processed, thereby providing the window length optimized for the signal. In addition, the method uses peak feature information having a close correlation there between, so that the method can easily update windows while minimizing variance even if a voice signal is discontinuous and transient, and can select a window length optimized for a signal. Also, this method is robust to noise because the method is based on the analysis of peaks, which always exist at levels higher than the noise. In addition, since the present invention employs an update scheme using higher-order peaks which have a close correlation with a pitch, that is part of the most important information in a voice or audio signal, thereby providing a practical, efficient, and adaptive window alignment method which can minimize a connection problem between frames.

Figure 2:
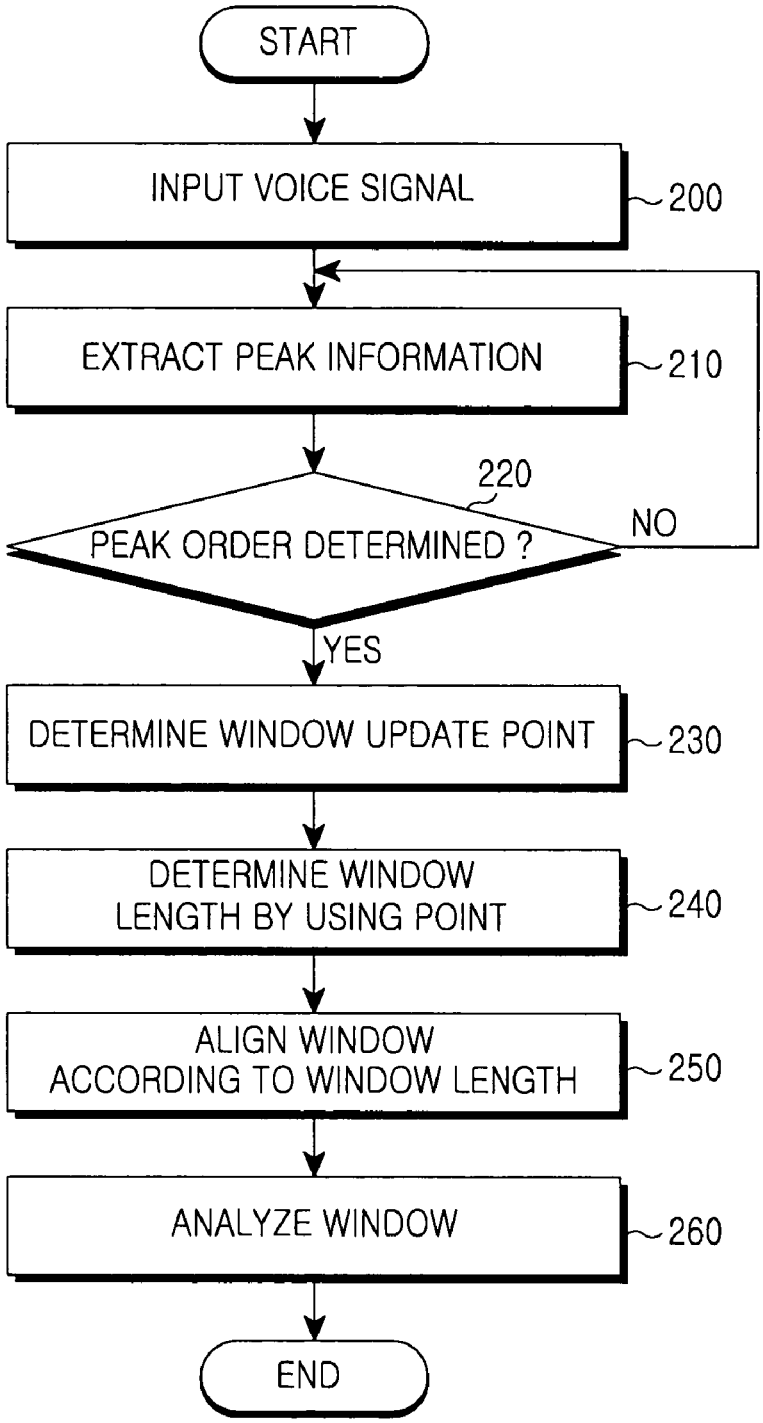
FIG. 2 is a flowchart schematically illustrating a procedure for aligning windows according to the present invention.

Hereinafter, the operation of the window alignment system will be described in detail with reference to FIG. 2. FIG. 2 is a flowchart illustrating a procedure for aligning windows according to the present invention.

First, the window alignment system receives a voice signal through a microphone in step 200, and extracts peak information from the voice signal in step 210. In this case, the window alignment system first extracts first-order peak information. Since a peak exists at a level higher than that of noise, the peak signal is more robust against noise than a zero-crossing signal subjected to noise, so that the present invention can be effectively implemented.

Then, the window alignment system determines an order to be used, by comparing the first-order peak information with an optimized reference value. Herein, the optimized reference value refers to a different value depending on systems using a voice signal, and represents a reference value capable of optimizing the corresponding system. Therefore, the optimized reference value, which can make the best use of the window alignment system, may be changed through repeated experimentation.

Then, after the comparison step, the window alignment system determines if a peak order has been determined in step 220. If the first peak information, which is current peak information, does not satisfy the reference value, the window alignment system returns to step 210 of again extracting peak information such that relatively higher peaks among the first-order peaks are newly defined as the second-order peaks. That is, as shown in FIGS. 3A to 3C, higher peaks among the first-order peaks, which appear as a serial time series based on time, are newly defined as the second-order peaks.

When a peak order has been determined by such a scheme, the window alignment system determines a window update point based on peak information of the determined order in step 230. When the window update point has been determined, the window alignment system shifts a window from the window update point until the next window update point appear. That is, whenever peaks sequentially appear on a one-by-one in a corresponding order, an update point is determined. Therefore, the window alignment system can determine a length from a window update point to a next window update point to be a window length, based on the determined update points in step 240. Such a window alignment system performs a window update by employing a shift mechanism.

Whenever a window length is determined when peaks sequentially appear on a one-by-one basis in the corresponding order, the window alignment system aligns a window according to the determined window length unit in step 250. In this case, a window update rate is automatically updated corresponding to a period of peak appearance in each order. When a window has been aligned in a window length unit, as described above, the window alignment system can know the start and end points of the window by using the window length, and performs window analysis for feature extraction in step 260.

With reference to an example, the above-mentioned procedure will now be described If a first second-order peak $P_2$ appears at a time point of 0 ms on the time axis as shown in FIG. 3C, the first second-order peak $P_2$ becomes a first update point. Then, when a second second-order peak $P_2$ appears on the time axis, the second second-order peak $P_2$ becomes a second update point. In this case, if the second second-order peak $P_2$ appears at a time point of 90 ms on the time axis, a corresponding window length corresponds to "90" which is a length between the first and second update points. In addition, a window is shifted from the second update point until a third second-order peak $P_2$ appears. If the third second-order peak $P_2$ appears at a time point of 200 ms on the time axis, a corresponding window length corresponds to "110" and the third second-order peak $P_2$ becomes a third update point.

Therefore, the window alignment system aligns a window having a window length unit of "90" and a window having a window length unit of "110", and performs feature extraction by analyzing a first window, which has a window length in a range of "0" (start point of first window) to "90". Then, the window alignment system performs feature extraction by analyzing a second window, which has a window length in a range of "90" (start point of second window) to "200". As described above, when the start and end points of a following window are known, it is possible to analyze the following window.

According to such a scheme, a window update rate is automatically determined according to the type of voice signal, thereby providing a window alignment method that can make the best use of the characteristics of a signal to be processed.

The following description will be given with respect to an example of aligning the start point of a fixed data window with a second-order peak for the purpose of actual feature extraction.

In the case of magnitude Gaussian data, one second-order peak appears every 9 data points (i.e. every 0.75 ms). However, if a sinusoid exists, the number of second-order peaks is reduced, and an average length between second-order peaks increases according to the frequency of the sine wave. Experimentally, in white Gaussian noise sampled with 30 dB SNR and 12 kHz, 13.3 second-order peaks exist in 256 data points on an average with respect to 200 Hz sinusoid. Therefore, a length between second-order peaks becomes approximately 16 ms on an average.

The window alignment method according to the present invention has an effect of improving feature repeatability, which is more efficient in a consistent voice signal such as a voiced sound.

In order to align windows, after a window is shifted, it is necessary to correlate the next window with the shifted window. To this end, the higher-order peak provides a shift mechanism for correlation between windows. This is possible because the higher-order peak enables the peak of a glottal waveform and a window to be aligned side by side. That is, when the higher-order peak is used, whenever a peak appears one by one in a corresponding order, a window is shifted corresponding to the peak, and a window length is determined based on time points at which peaks appear.

Therefore, as a higher correlation exists between two adjacent update points (particularly, in relation to voiced sound), further improved feature repeatability and variability can be obtained. That is, variability of irregularly changing a window length unit becomes decreased.

Meanwhile, the definition of a digital cross-correlation function as expressed in Equation (1) is used in order to measure a correlation between adjacent feature data windows.

$$\hat{R}_{xy} = \frac{1}{N}\sum_{n-1}^{N} x_n y_n \tag{1}$$

In Equation 1, variables "x" and "y" represent data points of adjacent feature windows. If windows are overlapped, the start point of data window "y" exists within data window "x". The start point of each window is determined by considering variability of the starting amplitude of the window, other than randomly. That is, the window alignment method according to the present invention forces a window to start at one peak among analogue peaks in a glottal pulse, so that information about the structure of a voiced sound can also be reflected in window alignment.

According to the present invention, a window starts at a second-order peak, which corresponds to an analog peak. The next window starts at the next second-order peak, which also corresponds to an analog peak. In order to align windows before a feature extraction step, the present invention uses the higher-order peak information of a voice signal waveform, which is simple but important, thereby facilitating the next-stage signal processing, such as voice detection, coding, recognition, synthesis, etc.

Particularly, since the present invention uses higher-order peaks as shown in FIGS. 3A to 3C, it is possible to further improve a correlation function. That is, an order is determined corresponding to a degree of variance reduction, and the peaks of the determined order are used for window alignment.

Such a window alignment method can be explained with reference to D. G. Childers and K. Wu, "Gender Recognition From Speech. Part II: Fine analysis,". Journal of the Acoustical Society of America, Vol. 90, No. 4, pp. 1841-1856, October 1991.

The above reference discloses that an average fundamental frequency of voiced sounds from a male speaker is approximately 124 Hz, and peaks of an analog sinusoid of magnitude data have an interval of about 16 ms in a time axis. When such information is intelligently utilized, the maximum second-order peak can be found from a window having a window length of 40 ms, and the 40 ms window includes two pitch peaks on an average, so that the second-order peak may always become a pitch peak. Therefore, when it has been established that the next window starts at a second-order peak which is spaced from a current peak by 14 ms or more, it is possible to achieve a window alignment method capable of starting each window at all times at a pitch peak. Consequently, when it is possible to use pitch information, pitch peaks can be used in place of the higher-order peaks. When a peak appears in a corresponding order by applying the concept of the higher-order peak as shown in FIGS. 3A to 3C, the peak is selected as the start point of a window. In this case, the peak may be selected as a center point of the window.

Particularly, although simple, the window alignment method based on the concept of the higher-order peak according to the present invention can provide a very efficient solution when a high correlation is a unique element to determine the efficiency of feature extraction.

The efficiency of feature extraction is dependent on a complicated trade-off between a degree of stable energy included in a window and a type of wave movement useful for feature stability. For instance, when a glottal pulse starts, a waveform may start with a sudden discontinuity due to the fluidity of a vocal cord. Such a discontinuity causes a violation of an assumption of an autoregressive signal model, when an LPC coefficient is used as a feature. Generally, the use of a Hamming window can reduce a large part of the discontinuity, thereby also reducing an effect of the discontinuity on feature extraction. In this case, it should be noted that, when pitch peaks having a long width become a window, an average energy is also reduced, which is expressed as Table 1.

TABLE 1

| | Mean Values | | | Standard Deviation | | |
|---|---|---|---|---|---|---|
| Phoneme | $1^{st}$ order peaks | $2^{nd}$ order peaks | $3^{rd}$ order peaks | $1^{st}$ order peaks | $2^{nd}$ order peaks | $3^{rd}$ order peaks |
| EY | 45.3 | 12.8 | 3.4 | 3.8 | 2.1 | 1.2 |

Table 1 represents a statistical table of the first-order to third-order peaks for phoneme EY in a 512-point window.

The present invention provides a method for adaptively changing and establishing a window length, by using a shift mechanism of a glottal pulse based on the higher-order peak in a data window. That is, the start point of a window and an overlap degree of windows are determined based on a peak shifting logic, thereby automatically determining a window length. For instance, a first-determined update point among second-order peaks is established as the start point of a window, the window is shifted from the start point, and the shift of the window ends at a point at which the next peak appears. In other words, the status of peaks appeared in an order, that is, the variance of peaks is a factor for determining a window length. As described above, the adaptive procedure according to the present invention provides a logical environment for a variable feature window.

In addition to the above-mentioned method of the present invention, methods capable of reducing variance of feature extraction include a shading method (i.e. filtering or lifting method) for attenuating the first and end of a capstral coefficient. Generally, the first portion of the capstral coefficient is sensitive to a spectral envelope, and the end portion of the capstral coefficient is sensitive to noise. Therefore, although such a method using the capstral coefficient can reduce variance so as to improve repeatability, there is a disadvantage in that much of the voice signal energy is removed. In contrast, the window update method according to the present invention, which uses window alignment based on the higher-order peak, can significantly improve stability of feature extraction while maintaining a voice signal at a high energy level.

Figure 4:
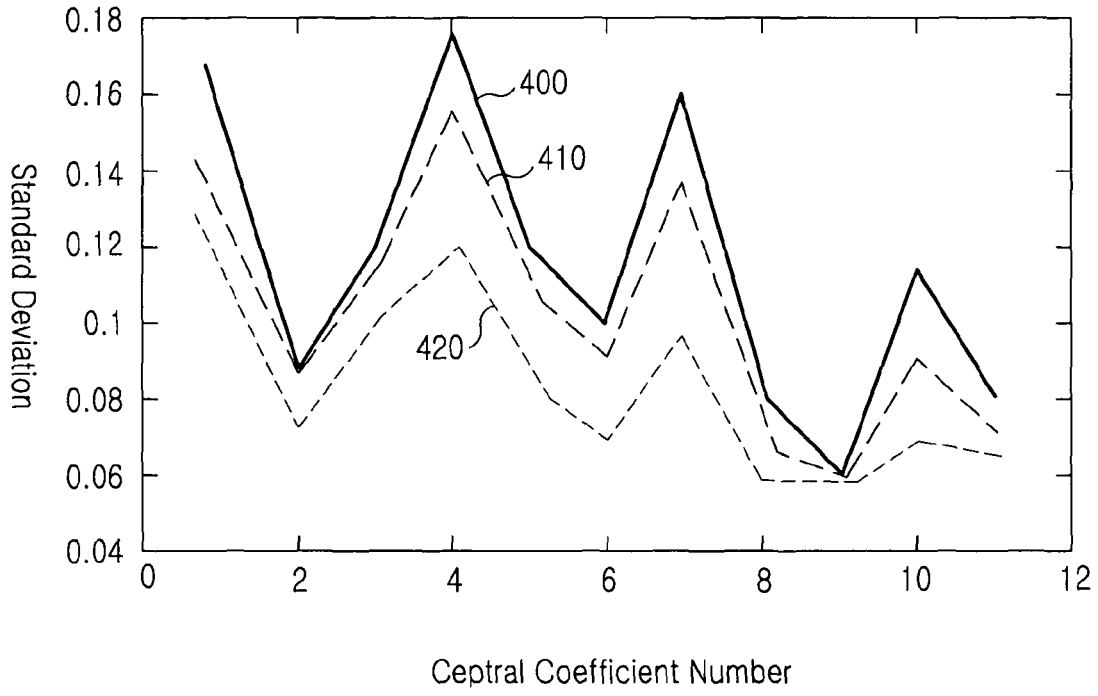
FIG. 4 is a graph illustrating the standard deviations of capstral coefficients according to the present invention.

Hereinafter, a detailed example of the present invention will be described with reference to FIG. 4. FIG. 4 is a graph illustrating the standard deviations of capstral coefficients according tithe present invention. In detail, FIG. 4 shows the standard deviations of capstral coefficients with respect to 80 128-point windows of an EY sound shown in Table 1.

In FIG. 4, a solid curve indicated by reference numeral 400 represents a case to which the conventional fixed update window scheme is applied without causing an overlap with 128 points. A middle dashed curve indicated by reference numeral 410 represents a case of employing a method of shifting a window within a range of 0 to +30 points in order to obtain the highest second-order peak from 128 samples. A bottom dotted curve indicated by reference numeral 420 represents a case of finding the highest second-order peak by moving within a range of −30 to +30 so as to use the found highest second-order peak as the start point of a window. Referring to FIG. 4, it can be understood, when the method according to the present invention is employed, a standard deviation is largely reduced, which means that the method of the present invention provides a more improved feature extraction performance as compared with the conventional method, which is characterized as the top solid curve. Accordingly, it can be confirmed through FIG. 4 that the present invention provides an improved performance.

The following description will be given with respect to a detailed example of the present invention. In order to find out a degree of performance improvement provided by the present invention, it is necessary to compare 1500 point segment data sampled at 8 kHz for vowel sound "EY" which distinctly presents repetition of a glottal event.

Such a phoneme may be regarded as a brief phonetic unit, but actually, one phoneme consists of many glottal microevents, which are consistent and smaller than the phoneme. Herein, the second-order peak provides a simple mechanism to align feature data windows based on glottal waveform peaks.

In a case of a typical feature window parameter in which a window length of "N=128" and an update rate of "3 ms" have been determined, e.g., in the case of "EY", since 8 kHz sampling rate is employed, the "3 ms" corresponds to 24 points. Therefore, when a fixed data window length and fixed update rate are applied, the average of a correlation function becomes 308.8.

In contrast, when a correlation function is calculated according to the method of the present invention, e.g., when a correlation with respect to the first portion of each window is considered, every window starts at a different second-order peak, so that the average of a correlation function increases by approximately 40%, thereby becoming 435.8. This verifies that feature repeatability has been improved in view of a continuous voice processing system.

In addition, temporal separations between second-order peaks are actually changed within a range of about 9 to 36 points. Therefore, a window update rate is not fixed, but is adaptively changed, thereby achieving a higher correlation between adjacent data windows in a vowel. By such an improved correlation between adjacent data windows, it is possible to provide more-improved feature stability in a feature extraction procedure.

As described above, according to the present invention, since a window alignment method using the concept of a higher-order peak is provided, it is possible to know the start and end points of a window that adaptively changes, thereby facilitating peak feature extraction and analysis.

In addition, according to the present invention, since the start and end points of each window is selected based on peak information of a corresponding order, it is possible to easily update windows while minimizing variance even if voice signals are discontinuous and transient.

Also, the method according to the present invention has an advantage in that the method can be applied all voice signal processing systems upon voice coding, recognition, synthesis, and reinforcement.

While the present invention has been shown and described with reference to certain preferred embodiments thereof, it will be understood by those skilled in the art that various changes in form and details may be made therein without departing from the spirit and scope of the invention as defined by the appended claims. Accordingly, the scope of the invention is not to be limited by the above embodiments but by the claims and the equivalents thereof.

What is claimed is:

1. A system for aligning a window to extract a peak feature of a voice signal, the system comprising:

a peak information extraction unit configured to receive a voice signal and extract peak information from the received voice signal;

a peak order determination unit configured to receive the peak information from the peak information extraction unit and determine a peak order based on the extracted peak information;

an update point determination unit configured to receive the peak order information from the peak order determination unit and determine a window update point using peak information of the peak order determined by the peak order determination unit;

a window length determination unit configured to determine a window length by shifting a window based on the update point;

a window alignment unit configured to align a window according to the determined window length; and a window analysis unit configured to perform window analysis for feature extraction by detecting start and end points of the window from the aligned window, wherein the system is implemented by at least one processor, and wherein $1^{st}$ order peaks of a signal include peaks of the signal, and $(n+1)^{th}$ order peaks of the signal are peaks of a signal represented by line segments directly connecting adjacent $n^{th}$ order peaks, where n is an integer greater than or equal to 1.

2. The system as claimed in claim 1, wherein the update point determination unit updates a window update point whenever a peak appears in the peak order.

3. The system as claimed in claim 1, wherein the window length determination unit starts a window based on a current update point and shifts the window until a next peak appears.

4. The system as claimed in claim 1, wherein the window analysis unit performs the window analysis based on the start point of the window and the determined window length.

5. The system as claimed in claim 1, wherein, when peak information is extracted by the peak information extraction unit from a voice signal on a time domain, the peak order determination unit defines a peak order of the extracted peak information, compares a peak feature value of the defined current peak order with a preset threshold peak feature value, and determines the current peak order to be the peak order when the peak feature value is greater than or equal to the threshold peak feature value.

6. The system as claimed in claim 5, wherein, when the peak feature value is less than the threshold peak feature value, the peak order determination unit defines a new peak order by increasing the current peak order, compares a peak feature value of the new peak order with the threshold peak feature value, and repeats the peak order determining procedure until the peak feature value is at least the threshold peak feature value.

7. A method for aligning a window to extract a peak feature of a voice signal, the method comprising the steps of:

extracting peak information from a received voice signal;

determining a peak order based on the extracted peak information;

determining a window update point using the peak information of the determined peak order;

determining a window length by shifting a window based on the update point;

aligning a window according to the determined window length; and performing window analysis for feature extraction by detecting start and end points of the window from the aligned window, wherein $1^{st}$ order peaks of a signal include peaks of the signal, and $(n+1)^{th}$ order peaks of the signal are peaks of a signal represented by line segments directly connecting adjacent $n^{th}$ order peaks, where n is an integer greater than or equal to 1.

8. The method as claimed in claim 7, wherein, in the window length determination step, a window starts based on a current update point and is shifted until a next peak appears.

9. The method as claimed in claim 7, wherein, in the window analysis step, the window analysis is performed based on the start point of the window and the determined window length.

10. The method as claimed in claim 7, wherein the peak order determination step comprises extracting peak information from a voice signal on a time domain;

defining a peak order of the extracted peak information;

comparing a peak feature value of the defined current peak order with a preset threshold peak feature value; and determining the current peak order to be the peak order when the peak feature value is greater than or equal to the threshold peak feature value.

11. The method as claimed in claim 10, further comprising:

defining a new peak order by increasing the current peak order when the peak feature value is less than the threshold peak feature value;

comparing a peak feature value of the new peak order with the threshold peak feature value; and repeating the peak order determining procedure until the peak feature value is greater than or equal to the threshold peak feature value.

* * * * *